United States Patent [19]

Diem

[11] 4,175,535

[45] Nov. 27, 1979

[54] RANDOM PROPELLING DEVICE FOR BALLS AND THE LIKE

[76] Inventor: Carl H. Diem, 3969 68th St., Franksville, Wis. 53126

[21] Appl. No.: 830,595

[22] Filed: Sep. 6, 1977

[51] Int. Cl.[2] ..... F41B 3/04

[52] U.S. Cl. ..... 124/7; 124/41 R; 124/36; 124/81

[58] Field of Search ..... 124/7, 6, 36, 41 R, 124/50, 49

[56] References Cited

U.S. PATENT DOCUMENTS

| | | | |
|---|---|---|---|
| 3,602,208 | 8/1971 | Huerlimann | 124/41 R X |
| 3,659,576 | 5/1972 | Eade et al. | 124/7 |
| 3,779,227 | 12/1973 | Scott | 124/50 X |

*Primary Examiner*—Richard C. Pinkham
*Assistant Examiner*—William R. Browne
*Attorney, Agent, or Firm*—Andrus, Sceales, Starke & Sawall

[57] ABSTRACT

A pitching or batting device for a plurality of balls and the like includes an arm connected at one end to a torsion wind-up device and adapted at its other end to engage a holding cam. The cam is freely rotatable and is spun upon release of the arm tip therefrom so that it assumes a different random position in each cycle. When the arm holding a ball is released, the wind-up mechanism causes the arm to swing and engage a braking device which suddenly slows the arm, causing a pitched ball to be propelled through space. The cam causes the intervals between pitches to be random. The braking device is continuously adjustable in angular position, and a ball reverse spinning device may be employed which also operates randomly in conjunction with variations in height of the braking device.

11 Claims, 12 Drawing Figures

30
31
32
29
9
8
5
11
38
36
6
35
4
34
22
20
19
27
25
23
24
1
3
2

Fig. 9
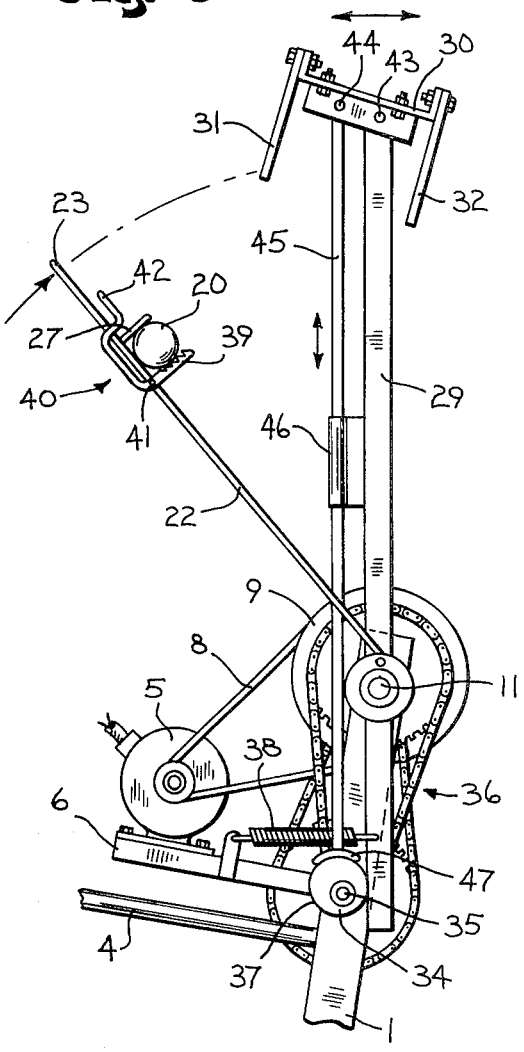
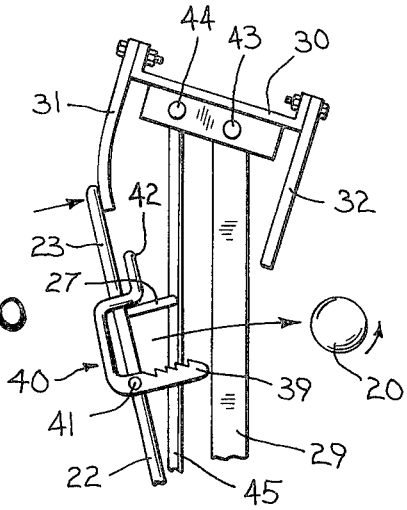
Fig. 10
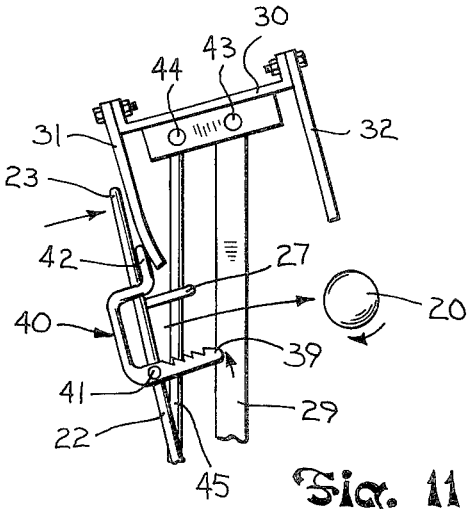
Fig. 11
Fig. 12
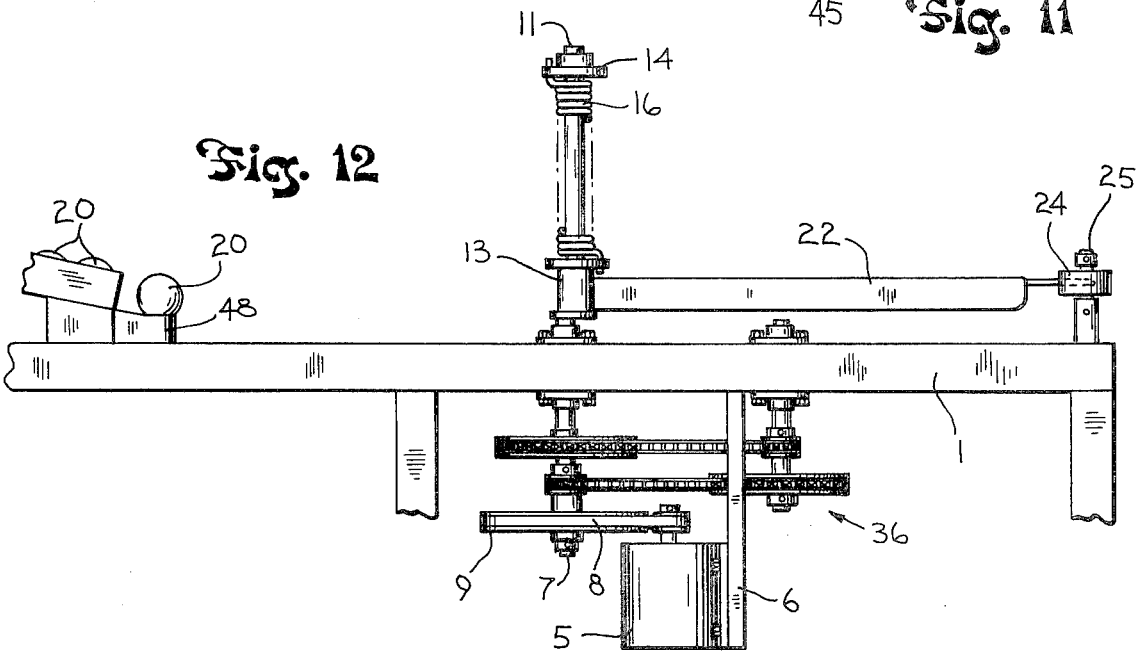

RANDOM PROPELLING DEVICE FOR BALLS AND THE LIKE

PRIOR ART OF INTEREST

U.S. Pat. No. 1,190,565—Long—July 11, 1916
U.S. Pat. No. 1,825,882—Mauney—Oct. 6, 1931
U.S. Pat. No. 3,213,842—Laney—Oct. 26, 1965
U.S. Pat. No. 3,213,843—Laney—Oct. 26, 1965
U.S. Pat. No. 3,602,208—Huerlimann—Aug. 31, 1971
U.S. Pat. No. 3,659,576—Eade et al—May 2, 1972
U.S. Pat. No. 3,867,921—Politzer—Feb. 25, 1975
U.S. Pat. No. 3,892,217—Raty—July 1, 1975

BACKGROUND AND SUMMARY OF THE INVENTION

This invention relates to a propelling device for balls and the like. More particularly, the device is contemplated for use in pitching or striking, such as batting, an object such as a ball or clay pidgeon so that the object becomes a projectile which is propelled through space.

With the present device and in the case of a ball, it may be pitched or batted toward a person for practice batting or catching. A clay pidgeon may also be pitched for target shooting practice.

Prior devices have been developed which will perform at least some of the aforementioned functions, as per the above-identified patents. Some of them utilize a batting arm which is connected to a torsion spring wind-up mechanism which, when released, causes the arm to suddenly accelerate to engage the projectile and project it through space. Some of these prior devices also are adjustable to selectively vary the timing between each sudden arm acceleration so that a plurality of projectiles can be pitched at short or long intervals. However, for a particular setting, the interval is always the same.

The present invention is directed to a unique improvement over prior known devices.

In accordance with one aspect of the invention, means are provided to release the wound-up arm at random intervals so that the operator can never be certain as to when the object is going to be propelled. Thus, the operator must always be on his guard, whether he is practicing batting, catching or shooting. In the present embodiment, the wound-up arm is first held and then released from a freely rotatable cam, the surface of which assumes random positions caused by spinning of the cam at the time of the previous release of the arm from the cam.

In accordance with another aspect of the invention, the amount of wind-up torsion and thus the acceleration of the released arm are dependent on the random wind-up time interval, and are thus also random in nature. Thus, the speed of propulsion of the object randomly varies as well as its timing.

In accordance with yet another aspect of the invention, means may be provided to constantly vary the angle of the accelerating arm at the moment of release of a pitched object. Since the time of arm release from the cam randomly varies, so does the moment of object release and the arm's attendant angle, thus providing a random angle of projection of the object.

In accordance with still another aspect of the invention, and when a ball is to be pitched, means may be provided to randomly cause the ball to reverse spin upon release from the arm, the velocity of spin also being random in accordance with the particular speed of the arm at the moment of ball release.

BRIEF DESCRIPTION OF THE DRAWINGS

The drawings furnished herewith illustrate the best mode presently contemplated by the inventor for carrying out the invention.

In the drawings:

FIG. 9 is a view similar to FIG. 1 and showing the addition of a random ball reverse spinning device, with the arm and ball approaching the brake;

FIG. 10 is a fragmentary view of the embodiment of FIG. 9 with the ball being pitched with its normal spin;

FIG. 11 is a view similar to FIG. 10 and showing the ball being reverse spun which pitched; and FIG. 12 is a side elevation of the device when used for batting a ball.

DESCRIPTION OF THE PREFERRED EMBODIMENT

Figure 1:
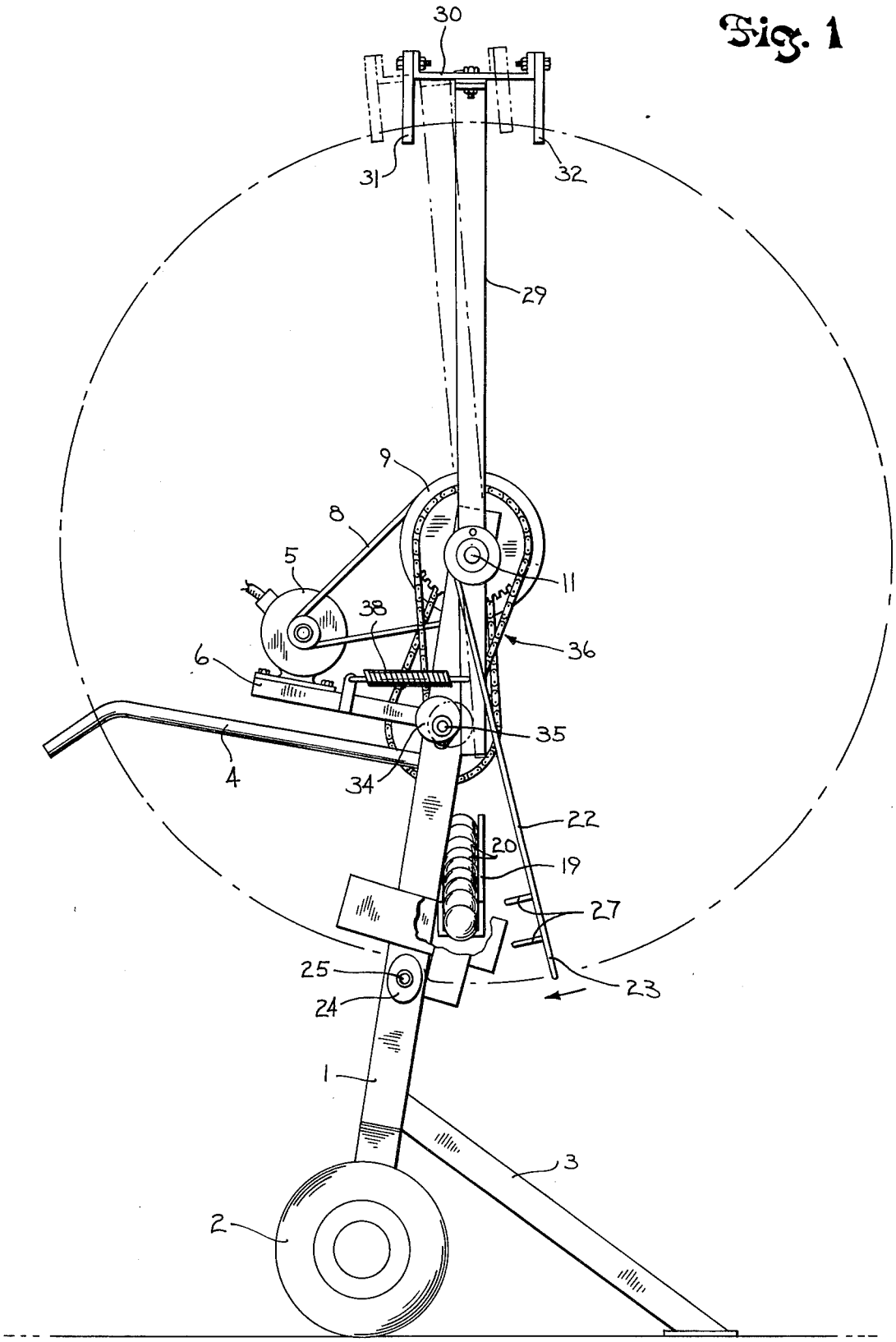
FIG. 1 is a side elevation of a device constructed in accordance with the invention.
Figure 2:
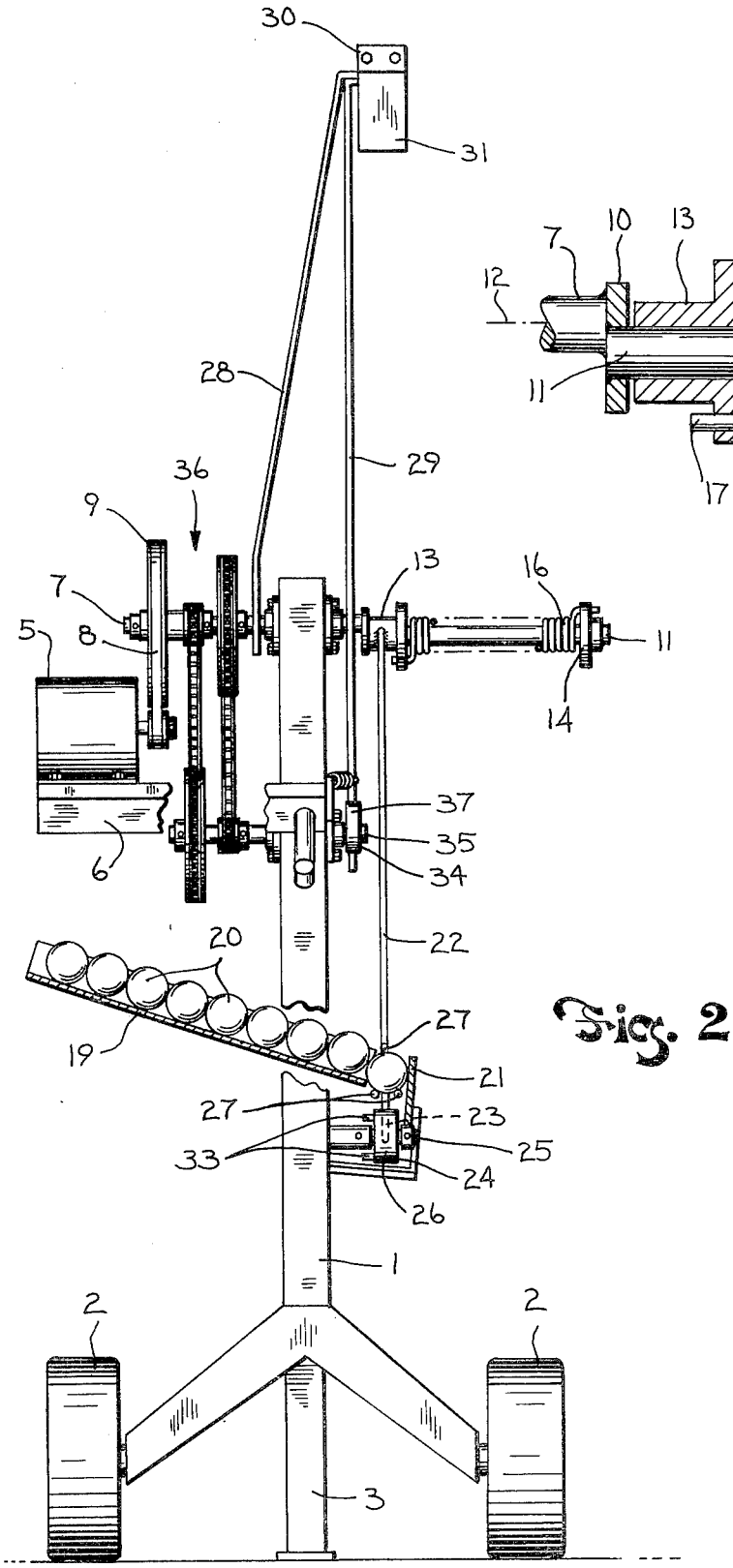
FIG. 2 is a front elevation of the device.

At best shown in FIGS. 1 and 2 of the drawings, the projecting device is adapted for use in pitching a plurality of balls in succession although other objects could be pitched without departing from the spirit of the invention. The device includes an elongated frame 1, wheels 2, a supporting stand 3, and a handle 4 for transporting the device along the ground. A motor 5 is mounted on a platform 6 forming a lateral extension of frame 1 and is connected to drive a main drive shaft 7 through a belt 8 and pulley 9.

Figure 3:
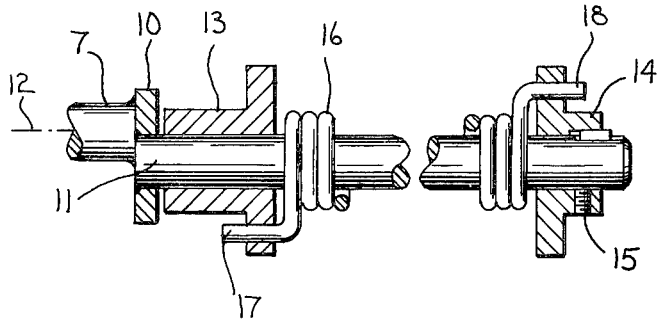
FIG. 3 is an enlarged fragmentary view, with parts in section, of the torsion wind-up mechanism.

Shaft 7 extends through frame 1, and on the side remote from motor 5 it serves to drive a ball pitching mechanism. For this purpose, and as best shown in FIGS. 2 and 3, the outer end of shaft 7 has a plate 10 thereon to which is connected a secondary shaft 11 which extends outwardly from shaft 7 but which is offset from the axis 12 of the latter. Shaft 11 thus rotates eccentrically about axis 12 of shaft 7.

An inner bearing 13 and an outer bearing 14 are mounted on secondary shaft 11, with bearing 13 being freely rotatable on the shaft and bearing 14 being fixed thereto, as by a set screw 15. A torsion spring 16 is mounted on shaft 11 between the bearings and the spring end stub portions 17 and 18 are connected thereto. The arrangement provides a torsion type wind-up mechanism for the projecting device, as will be described.

In the present embodiment, means are provided to pitch a plurality of objects in succession. For this purpose, a chute 19 is spaced from shaft 7 on the frame and is adapted to receive a plurality of balls 20, with the lowermost ball exposed and also held in place by a stop 21. An arm 22 is fixedly connected at its inner end to inner bearing 13 and is of such a length that when the arm extends in the direction of chute 19, the outer arm tip 23 extends beyond the chute to the vicinity of a cam 24 disposed in the path of the arm. Cam 24 is mounted for free rotation on a shaft 25 which is mounted to frame 1. As shown, cam 24 is non-circular and provides a cam surface 26 adapted to be engaged by arm tip 23 and impede its movement, as will be described.

A plurality of fingers 27 are disposed on arm 22 and inwardly from its tip 23 and are adapted to pick up one ball at a time and hold it for pitching. Generally, when a ball is picked up and time has elapsed, arm 22 swings upwardly until it engages a brake means which suddenly slows the arm movement. As shown, the brake is remote from cam 24 and comprises a pair of supports 28 and 29 through which main shaft 7 passes and which extend upwardly to a bracket 30. A pair of flexible arrestor pads 31 and 32 are suspended from bracket 30, with pad 32 being spaced downstream or clockwise from pad 31, as viewed in FIG. 1. Pad 31 is adapted to provide the primary slowing force for arm 22, while pad 32 is adapted to absorb most of the arm's remaining rotary energy.

Turning now to FIGS. 1–8 and the operation of the device, as motor 5 rotates shaft 7, normally at about 10 r.p.m., arm 22 is caused to rotate clockwise about shaft 7 until it approaches chute 19 (FIG. 1) and fingers 27 pick up a ball 20 (FIG. 2). At the same time, arm tip 23 engages surface 26 of cam 24 (FIG. 4) and is thus prevented from rotating further. However, shafts 7 and 11 continue to rotate, causing torsion spring 16 to wind up on shaft 11.

Figure 4:
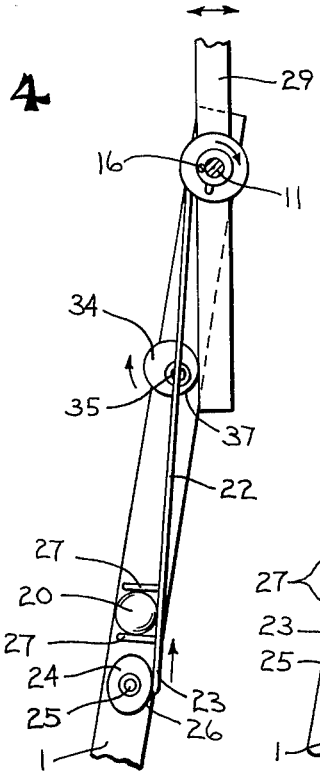
FIG. 4 is a fragmentary side elevation of the pitching arm and retaining cam, and also showing the pivotal movement of the brake support.
Figure 5:
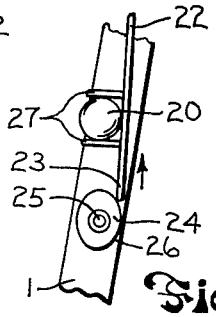
FIG. 5 is a fragmentary side elevation showing the pitching arm being withdrawn from the cam.
Figure 6:
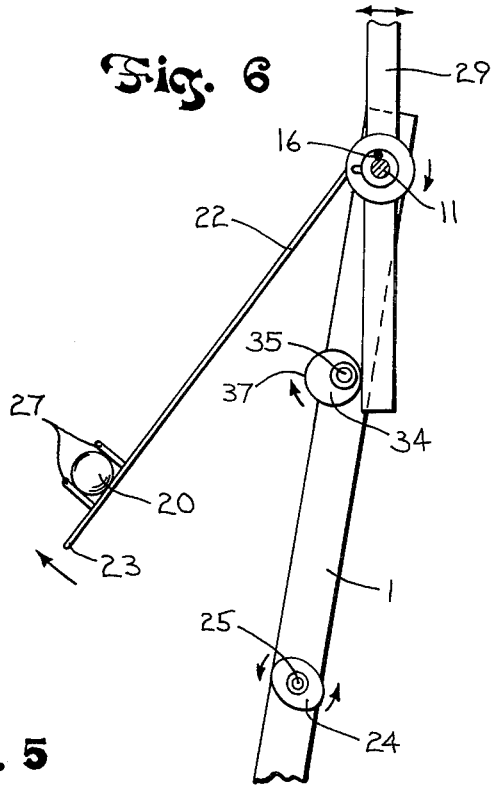
FIG. 6 is a view similar to FIG. 4 and showing release of the pitching arm from the cam and the subsequent arm and cam movements.
Figure 7:
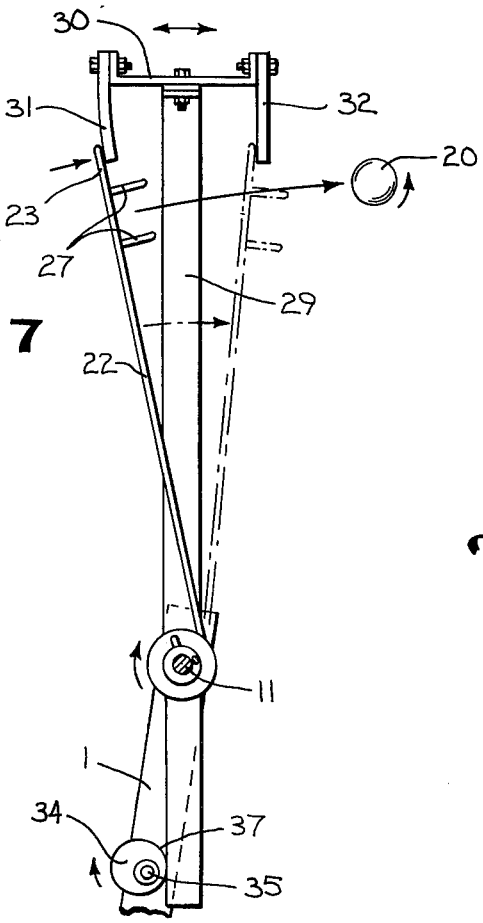
FIG. 7 is a view showing the arm engaging the brake and the ball being pitched.

Due to the eccentric rotation of shaft 11 during rotation of shaft 7, arm tip 23 will gradually withdraw from cam 24 at a constant speed until it is suddenly released therefrom (FIGS. 4–6). At this point, the stored up energy in spring 16 causes arm 22 to acceleratingly swing clockwise upwardly until arm tip 23 engaged arrestor pad 31 which suddenly slows the arm's movement. The inertia of ball 20 is such that it is released from fingers 27 and is propelled or projected forwardly for action by a batter or the like (FIG. 7). Centrifugal force causes the ball to spin counter-clockwise upon projection. Pad 32 further slows arm 22 and the latter then continues clockwise until its tip 23 again engages cam 24 for the next ball handling cycle.

In accordance with one aspect of the invention, the time intervals between propelling release of each successive ball from cycle to cycle are completely random. This is accomplished by randomly varying the time necessary for arm tip 23 to be released from cam 24. It has been mentioned that cam 24 is non-circular and is freely rotatable. As shown, the cam is generally oval, and in FIGS. 4–5, the distance tip 23 must travel to be released from the cam is at a maximum. Upon sudden tip release, cam 24 is caused to freely spin by the tip (see FIGS. 5, 6 and 8) and it will come to rest each time at a different random rotary position, somewhat like a roulette wheel. It can be assured that the stopping position is random, regardless of the shape of the cam, if it is balanced on its axis, such as by external weights 33. See FIG. 2.

Figure 8:
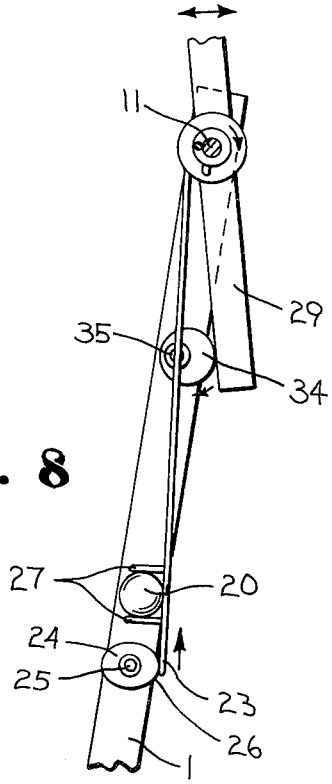
FIG. 8 is a view similar to FIG. 4, with the arm engaging a different surface portion of the cam.

After spinning as per FIG. 6, cam 24 is shown in FIG. 8 as coming to rest at a different rotary position which in this case provides a much shorter longitudinal travel of arm tip 23, and a much shorter time, before release thereof. The tip travel and time will thus randomly vary depending on the particular stopped cam position.

It is to be noted that the length of time arm tip 23 is held captured by cam 24 affects the amount of wind-up of torsion spring 16, because motor 5 runs continuously and shaft 11 continues to turn during this period. The longer tip 23 is un-released, the longer shaft 11 turns and the greater the torsional energy stored in spring 16. The greater the stored torsional energy, the greater the acceleration of arm 22 upon release, the greater its speed upon engaging pad 31, and the greater the resultant speed of the propelled ball. The reverse also holds true. Therefore, the mechanism also provides means to randomly vary the velocity of a series of propelled objects.

The device also provides means to randomly vary the angle of the propelled object, which adds an additional challenge to a batter, shooter or the like. For this purpose, and referring to the embodiment of FIGS. 1–8, brake support 29 extends downwardly from shaft 7 for engagement with a non-circular cam 34, which is fixed to a supplemental drive shaft 35 which extends through frame 1 and is driven from motor 5 by any suitable means, such as the reduction type chain drive 36. The outer end of support 29 is supportingly biased against the cam surface 37 by a spring 38 connected between platform 6 and the said support. Rotation of cam 34 causes support arm 29 and the entire brake assembly to pivot about main shaft 7, thus causing brake pads 31 and 32 to oscillate and assume a constantly varying angular position at about 180° from main cam 24. See FIG. 1. The angular distance the released arm 22 travels from cam 24 to brake pad 31 therefore varies. Although the angular movement of the oscillating brake is not random, the time of release of the arm from cam 24 is, and the arm's accelerating speed also is, so that arm tip 23 will engage pad 31 at an unpredictable random angular position of the latter. Since the angular attitude of pad 31 upon impact affects the angle of propulsion of a ball 20 out of the device, the angle of propulsion therefor changes at random. Note the arrows adjacent the braking assembly in FIGS. 4–8.

In some instances, when a ball 20 is to be pitched, it may be desirable to provide means to impart a reverse spin to the ball. In accordance with another aspect of the invention, the ball is randomly spun in a reverse direction from normal and the velocity of ball spin is also random.

Referring to the embodiment of FIGS. 9–11, arm 22 includes at least several ball receiving relatively smooth fingers 27. However, one of the fingers 27 is replaced by a serrated or high friction finger 39 having an inner ball contacting surface. Finger 39 forms part of a generally U-shaped element 40 which is pivotable about a shaft 41, the latter extending through arm 22. The end of element 40 remote from finger 39 forms a clamping trigger 42 disposed on the clockwise or downstream side of arm 22 and which terminates inwardly of the end of arm tip 23. As shown in FIG. 9, a ball 20 is adapted to be held between fingers 27 and finger 39, with the contact being generally loose.

In addition, means are provided to continuously vary the height of brake pad 31. For this purpose, and in this embodiment, bracket 30 is pivotally mounted on support 29, as at 43; and is connected through another pivot 44 to an actuator shaft 45 which extends inwardly parallel to support 29 and through a holder 46 to adjacent lower cam 34. At its inner end, shaft 45 has a curved cam follower 47 thereon which rests on cam surface 37.

Thus, as cam 34 rotates, it not only causes the brake assembly to change its angular attitude, but also causes shaft 45 to extend and retract as shown by the arrows in FIG. 9, thus pivotally raising and lowering brake pad 31 about point 43.

As shown in FIG. 10, when pad 31 is raised and arm 22 approaches the brake, arm tip 23 will engage the pad and ball 20 will be propelled outwardly with its normal counter-clockwise spin in view of the rather loose finger holding in this instance. However, and as shown in FIG. 11, when pad 31 is lowered and arm 22 approaches the brake, pad 31 will be engaged by trigger 42 which causes element 40 to pivot about shaft 41 so that serrated finger 39 shifts inwardly to clamp or grip ball 20 and hold it against the other fingers. When arm 22 is suddenly slowed, the high friction surface of finger 39 will impart a reverse or clockwise spin to ball 20 as it is propelled forwardly, causing it to curve as it flies through space.

In view of the previously described random swinging of arm 22, and even though the pivoting of the brake is not in itself random, the engagement of pad 31 by tip 23 or trigger 42 will be at random and unpredictable. Thus, it can never be known in advance whether the ball will be spun in reverse or not. Likewise, the velocity of ball spin and its angle varies and cannot be predicted because of the unpredictable variance of angular speed and position or arm 22 when pad 31 is engaged. Thus the curve and direction of the ball will also vary at random.

The device of the invention may also be used to bat or strike objects, such as balls. FIG. 12 illustrates such usage wherein the elements are turned so that arm 22 swings in a horizontal rather than vertical plane. In this instance, although fingers 27 and the brake are not necessary, the random action of arm 22 via cam 24 is still present so that the time when arm 22 hits a ball 20 fixedly positioned on a stand 48 in the path of arm 22 is unpredictable.

The invention provides a unique mechanism for propelling objects which is a major improvement over prior devices. The control system causes the time intervals between propulsion of successive objects, the speed, and the angle of propulsion to be completely and automatically random. These functions are infinitely variable within the limits provided by the particular mechanism. Furthermore, when a ball is to be reverse spun upon release, the spinning is at random, as is the velocity of spin.

Various modes of carrying out the invention are contemplated as being within the scope of the following claims particularly pointing out and distinctly claiming the subject matter which is regarded as the invention.

I claim:

1. A device for propelling a plurality of balls or the like in succession through space, comprising, in combination:

(a) a frame, (b) a ball propelling arm mounted for pivotal swinging relative to said frame, and adapted to cyclically propel a succession of balls, (c) drive means to pivotally swing said arm, (d) means disposed in the path of said arm to impede the swinging of said arm, (e) means to build up torsional energy in said arm while its swinging is impeded, (f) means to release said arm from said swing impeding means to thereby release the torsional energy therein so that said arm acceleratingly swings, (g) and means associated with said swing impeding means to cause release of said arm therefrom at random time intervals from cycle to cycle.

2. The device of claim 1 in which:

(a) said swing impeding means comprises a cam engageable by the tip of said arm, (b) and said arm releasing means (f) comprises means to withdraw the tip of said arm from said cam.

3. The device of claim 2 wherein said random release means (g) comprises:

(a) means for mounting said cam for free rotation relative to said frame, (b) and a non-circular surface on said cam with said surface being engageable by said arm tip, (c) the construction being such that release of said arm tip from said cam surface causes said cam to spin to a random new rotary position so that the distance for withdrawal of said tip from said surface will be randomly different with each cycle.

4. The device of claim 1 which includes:

(a) ball holding means on said arm, (b) and brake means disposed remote from said swing impeding means and positioned for engagement by the accelerating arm so that the ball is released from said holding means and propelled through space.

5. The device of claim 4 wherein the amount of torsional energy stored in said arm before its release from the swing impeding means is responsive to said random release means (g) so that the accelerating velocity of said arm at the time of its engagement with said brake means is also random to thereby randomly vary the speed of propulsion of the ball from said arm and through space.

6. The device of claim 4 which includes means to randomly vary the angle of propulsion of the ball from said arm through space.

7. The device of claim 6 wherein said angle varying means comprises means to continuously shift the angular position of said brake means relative to said swing impeding means.

8. The device of claim 7 wherein said shifting means comprises:

(a) a pivotal support for said brake means, (b) a non-circular cam on said frame and with said cam being engaged by said support, (c) and means to move said cam to continuously oscillatingly pivot said support.

9. The device of claim 4 which includes means to randomly spin the said ball in a normal or reverse direction upon release thereof from said arm.

10. The device of claim 9 wherein said last-named means includes:

(a) a high friction element forming part of said ball holding means and pivotable between a ball holding and a ball clamping position, (b) a trigger connected to said high friction element and extending to inwardly of the end tip of said arm, (c) and means to vary the position of said brake means so that either said tip or said trigger engages said brake means depending on the position of said brake means when said arm is randomly released from said swing impeding means and approaches said brake means, (d) the construction being such that engagement of said brake by said trigger causes the ball to be clamped and reverse spun by said high friction element as it is propelled from the ball holding means.

11. The device of claim 10 wherein the amount of torsional energy stored in said arm before its release from the said swing impeding means is responsive to the said random release means so that the accelerating velocity of said arm at the time of random engagement of said trigger with said brake means is also random to thereby randomly vary the rotational velocity of the ball as it is propelled from said ball holding means.

* * * * *